US007381005B2

(12) United States Patent
Altonen et al.

(10) Patent No.: US 7,381,005 B2
(45) Date of Patent: Jun. 3, 2008

(54) PRESSURIZED DISPENSING PACKAGE AND METHOD FOR USING THE SAME

(75) Inventors: Gene Michael Altonen, West Chester, OH (US); Benjamin J. Beck, Boston, MA (US); David Harting, Needham, MA (US); Theresa Louise Johnson, Batesville, IN (US); Christine Marie Putman, West Chester, OH (US)

(73) Assignee: The Procter and Gamble Company, Cincinnati, OH (US)

( * ) Notice: Subject to any disclaimer, the term of this patent is extended or adjusted under 35 U.S.C. 154(b) by 0 days.

(21) Appl. No.: 11/710,180

(22) Filed: Feb. 23, 2007

(65) Prior Publication Data

US 2007/0172305 A1 Jul. 26, 2007

Related U.S. Application Data

(63) Continuation of application No. 10/610,298, filed on Jun. 30, 2003, now Pat. No. 7,195,414.

(51) Int. Cl.
*A46B 11/02* (2006.01)

(52) U.S. Cl. ..... 401/202; 401/190; 401/262

(58) Field of Classification Search ..... 401/190, 401/202, 262, 9, 98; 220/213, 252, 810, 220/820, 821, 836
See application file for complete search history.

(56) References Cited

U.S. PATENT DOCUMENTS 4,020,978 A 5/1977 Szczepanski
4,757,917 A * 7/1988 Gleich et al. ..... 222/95
4,867,325 A * 9/1989 Dransfield ..... 215/11.2
5,085,351 A 2/1992 Martin
5,160,089 A 11/1992 Radtke et al.
5,288,256 A * 2/1994 Lee et al. ..... 446/48
5,352,053 A 10/1994 Reitze
5,641,232 A 6/1997 Frey
5,649,645 A 7/1997 Demarest et al.
5,967,685 A 10/1999 De Laforcade
6,283,335 B1 9/2001 Young et al.

(Continued)

FOREIGN PATENT DOCUMENTS

EP 0336168 A1 10/1989

(Continued)

*Primary Examiner*—David J. Walczak
(74) *Attorney, Agent, or Firm*—Andrew J. Hagerty; Vladimir Vitenberg; Brian M Bolam

(57) ABSTRACT

A package for dispensing a pressurized material to be applied to the body. In one embodiment, the package comprises a container body having a cavity for containing a pressurized material to be applied to the body, the container body having an outer surface. An applicator is positioned adjacent the outer surface and is configured to dispense pressurized material. A cap is captively engaged with the container body, the cap being movable over the outer surface between a closed position in which the applicator is substantially shielded and an open position in which the applicator is substantially exposed. In another embodiment, the container body includes a body facing edge and a recessed surface bounded by the body facing edge, the recessed surface extending inwardly from the body facing edge. An applicator is configured to dispense the material and is positioned along the recessed surface.

5 Claims, 8 Drawing Sheets

U.S. PATENT DOCUMENTS

| | | | |
|---|---|---|---|
| 6,467,980 | B1 | 10/2002 | Krause |
| 6,488,429 | B2 | 12/2002 | Korper |
| 6,659,314 | B2 | 12/2003 | Garcia |
| 7,195,414 | B2 | 3/2007 | Altonen et al. |

FOREIGN PATENT DOCUMENTS

| | | | |
|---|---|---|---|
| EP | 1057536 | A2 | 12/2000 |
| FR | 141014 | A | 10/1965 |
| FR | 2 389 419 | | 12/1978 |
| JP | 61146267 | A | 7/1986 |
| JP | 5798275 | | 3/1989 |
| JP | 6448175 | | 3/1989 |
| JP | 6284925 | A | 10/1994 |
| JP | 200234643 | A | 2/2002 |
| WO | WO 0198178 | A1 | 12/2001 |

* cited by examiner 200
240
220
225
250
234
232
255
231
210
214
222

200
240
220
210
235
222

250
220
210
235
200

200
220
211
222
234
232
231
250
210
211
222 d
250
218
220
200
222
234
232
255
231
210
216
240
214

222
211
220
212
210
211
213

200
250
210
220

PRESSURIZED DISPENSING PACKAGE AND METHOD FOR USING THE SAME

CROSS REFERENCE TO RELATED APPLICATION

This application is a continuation of U.S. application Ser. No. 10/610,298, filed on Jun. 30, 2003, now U.S. Pat. No. 7,195,414, which claims the benefit of Provisional Application Ser. No. 60/615,864, filed Oct. 1, 2004.

TECHNICAL FIELD

The present invention relates generally to pressurized packages, and more particularly to packages for dispensing pressurized materials to be applied to the body.

BACKGROUND OF THE INVENTION

Materials to be applied to the body can be packaged in a variety of ways. For example, consumers today have a wide variety of choices for underarm deodorant/antiperspirant products. In particular, the physical forms of the products can vary among liquid materials, gel materials, solid materials and cream materials. Like the physical form of the product, the delivery systems and application techniques also vary significantly. For example, the product can be rolled, rubbed, or sprayed onto the body.

Moreover, with regard to products that are sprayed onto the body, a number of subcategories exist. More specifically, sprays can be delivered using aerosol or non-aerosol containers or using pump-type devices.

Based upon the material form and the delivery system, the sensation experienced by the user is determined. For instance, the material form and product delivery can affect whether the product feels wet, cool, soft, powdery, or creamy. Likewise, with spray-type products, the gassiness of the product, the force of the spray, and the amount of overspray all affect the user's experience with the product.

With regard to sprayed-on products, and spray-on antiperspirants and deodorants in particular, consumers often complain about the production of a gassy cloud, the difficulty in directing the spray to the correct area, and the mis-direction of the product onto clothing. This is because applying a spray antiperspirant/deodorant can be a somewhat challenging process, and can be even more challenging when attempting to apply the product while wearing a shirt or blouse. Holding the package too close to the underarm can cause a large amount of the product to be concentrated in only a small area of the underarm, thereby potentially decreasing the product efficacy, causing the product to feel too cold or too wet and sticky, and/or causing the product to drip down the skin and onto clothing. On the other hand, holding the package too far away from the underarm can cause the sprayed product to miss the underarm, to contact clothing, and/or to create a gassy, choking cloud that could be inhaled. Accordingly, maintaining the correct distance between the package and the user's skin is important.

Moreover, with regard to antiperspirant/deodorant products and other similar sprayed-on products, it can be desirable to conveniently carry such products throughout the day, so that they are readily available for quick, repeated use. However, oftentimes the packages for such products can be difficult to quickly handle. For instance, such products typically include removable caps, making handling of such products more cumbersome. Likewise, it can be difficult to quickly locate and actuate the actuator which causes the product to dispense. Moreover, such products can sometimes accidentally dispense while being carried.

Therefore, it is highly desirable to develop packages which address these and other issues that can arise with materials that are to be sprayed onto the body.

SUMMARY OF THE INVENTION

The present invention provides improved pressurized dispensing packages which overcome disadvantages associated with conventional packages.

According to one aspect of the invention, a package is provided for dispensing a pressurized material to be applied to the body. In one embodiment, the package comprises a container body having a cavity for containing a pressurized material to be applied to the body, the container body having an outer surface. An applicator is positioned adjacent the container body and is configured to dispense pressurized material. A cap is captively engaged (with the container body. The cap is movable over the outer surface between a closed position in which the applicator is substantially shielded and an open position in which the applicator is substantially exposed.

According to another aspect, a package is provided for dispensing a pressurized material to be applied to the body. The package comprises a container body sized to be conveniently portable. The container body includes a cavity for containing a pressurized material to be applied to a body surface, the package having at least one body facing edge and a recessed surface bounded by the at least one body facing edge. The recessed surface extends inwardly from the body facing edge. The package further comprises an applicator configured to dispense the material and positioned along the recessed surface.

In accordance with another aspect, a method is provided for applying a material to a body surface. The method comprises providing a package sized to be grasped with a hand. The package has a cavity for containing a pressurized material to be applied to a body surface, and the package further includes at least one body contacting edge and a recessed surface bounded by the at least one body contacting edge. The package further includes an applicator configured to dispense the material and positioned along the recessed surface and spaced inwardly from the body contacting edge, and a dispensing actuator configured to control dispensing of material from the applicator. The method further comprises placing the body contacting edge in contact with a body surface so as to maintain the spacing of the applicator and the body contacting edge, and pressing the dispensing actuator to cause material to be released from the applicator and toward the body surface.

Still other advantages, aspects, and embodiments of the present invention will become apparent to those skilled in this art from the following description wherein there is shown and described details of various embodiments of this invention, simply for the purposes of illustration. As will be realized, other different aspects and embodiments can be provided without departing from the invention. Accordingly, the drawings and descriptions are to be regarded as illustrative in nature and not restrictive in nature.

All documents cited are, in relevant part, incorporated herein by reference; the citation of any document is not to be construed as an admission that it is prior art with respect to the present invention.

BRIEF DESCRIPTION OF THE DRAWINGS

While the specification concludes with claims which particularly point out and distinctly claim the present invention, it is believed that the present invention will be better understood from the following description of illustrative embodiments, taken in conjunction with the accompanying drawings, in which like reference numerals identify like elements and wherein:

DETAILED DESCRIPTION OF ILLUSTRATIVE EMBODIMENTS

Figure 1A:
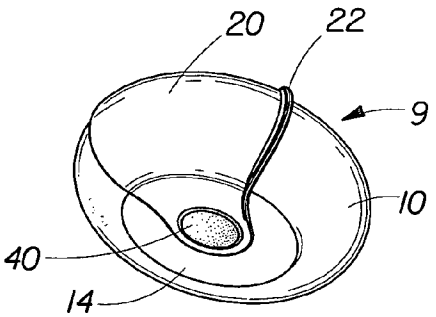
FIG. 1A is a top perspective view of one embodiment of a package for dispensing pressurized material, constructed according to principles of the present invention.
Figure 1B:
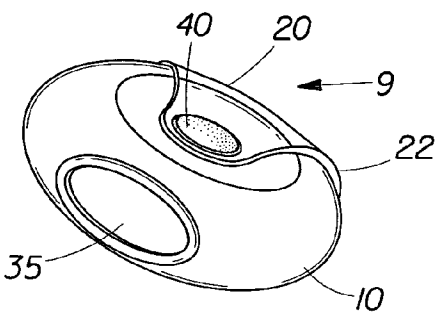
FIG. 1B is a bottom perspective view of the embodiment of FIG. 1A.
Figure 1D:
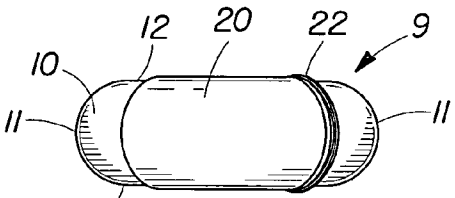
FIG. 1D is a top view of the embodiment of FIG. 1A.

The invention relates to packages for dispensing pressurized material to be applied to the body. In one embodiment, the package comprises a container body having a cavity for containing a pressurized material to be applied to the body, the container body having an outer surface. An applicator is positioned adjacent the container body and is configured to dispense pressurized material. A cap is captively engaged with the container body. The cap is movable over the outer surface between a closed position in which the applicator is substantially shielded and an open position in which said applicator is substantially exposed.

In some embodiments, the cap can be rotatable about a central pivotal axis on a substantially round container body, and can rotate to any number of selection positions. The actuator, in some embodiments, can be located near the center of the container body for ease in quickly locating the actuator. Moreover, in some embodiments, placing the cap in the closed position can disable or lock the actuator and prevent unintended dispensing of the product.

According to another aspect, a package is provided for dispensing a pressurized material to be applied to the body. The package comprises a container body sized to be conveniently portable. The package includes a cavity for containing a pressurized material to be applied to a body surface, the container body of the package having at least one body facing edge and a recessed surface bounded by the at least one body facing edge. The recessed surface extends inwardly from the body facing edge. The package further comprises an applicator configured to dispense the material and positioned along the recessed surface.

In some embodiments, the recessed surface comprises a concave surface, and in some embodiments an absorbent material can be placed on the recessed surface to absorb sprayed material that is deflected from the body. Furthermore, in some embodiments, the container body can comprise a substantially round outer configuration to provide improved handling of the package.

Turning now to the drawing figures, wherein like element numbers indicate like elements, FIGS. 1A-G show various views, discussed above, of one embodiment of a package 9 for dispensing pressurized material, constructed according to principles of the present invention. In particular, in this embodiment, a container body 10 is provided for containing the pressurized material to be dispensed. The container body 10 includes a cavity for containing pressurized material to be applied to the body. The pressurized material could comprise an antiperspirant and/or deodorant (hereinafter referred to as "antiperspirant/deodorant") material. Examples of such materials include pressurized antiperspirant compositions comprising solubilized antiperspirant active, a dimethylether propellant, and a low polarity solvent. For instance, the pressurized fluid could comprise a solution that exists in the container as a single phase, and upon release becomes two phases. Such compositions can be formulated as stable single phase or clear pressurized liquids without reliance upon ethanol, propylene glycol, or aqueous solvents. For example, such compositions could comprise (a) a polyol solvent having at least 4 carbon atoms and a hydroxyl group on each of the $\alpha$ and $\beta$ carbon atoms of the polyol solvent; (b) solubilized antiperspirant active; (c) dimethylether; and (d) a low polarity liquid having a solubility parameter of less than about 8.0, wherein the weight ratio of the dimethylether to low polarity solvent is from about 0.1 to about 3.0, as disclosed in U.S. patent application Ser. No. 09/864,012, entitled Stable Pressurized Antiperspirant Compositions Containing Dimethylether Propellant And A Low Polarity Solvent, the entire disclosure of which is hereby incorporated herein by reference.

The container body 10 can be made of any suitable flexible or rigid material for holding the desired pressurized material at the desired pressure. Examples of such materials include, but are not limited to, polyolephins, polyesters, nylon, vinyl, acrylic, polycarbonates, polystyrene, and/or polyeurothane, and/or other plastics. If a dimethyl ether propellant is utilized, then an amorphous nylon can be used to make the container body 10, to prevent the propellant from penetrating the walls of the container body, as disclosed in U.S. patent application Ser. No. 10/146,697, entitled Pressurized Package Made of Polyamide Resin and Containing Dimethyl Ether, the entire disclosure of which is hereby incorporated herein by reference. If desired, the container body 10 can be made with multiple layers, components, or members, such as by using a liner held within an outer shell for example.

Moreover, the container body 10 can be formed into any of a number of desired shapes. In this example, the container body 10 has a substantially round outer configuration, and more specifically, a substantially circular outer configuration when viewed from the front, such as in the view of FIG. 1C. The bottom side 35 of the container body 10 may be effectively flat, such as to allow for ease of placement on a table, countertop, or other flat surface. When viewed from the bottom or top sides, as in the views of FIGS. 1D and 1G, the container body 10 can also have curved or rounded edge walls 11, with front and back sides 12 and 13 having substantially flat areas 14. These and other suitable configurations can provide ease of handling and portability for a user. As an alternative, area 14 can be a hollow opening through the package 9.

Captively engaged with the container body 10 is a cap 20, such that the cap is held to, supported by, or otherwise directly or indirectly connected to the container both during storage of the package 9 and during use of the package. In particular, in this example, the cap 20 includes an opening through which an actuator button 40 extends. The actuator button 40 is then held to the container body 10, such as by a collar (not shown, but residing beneath cap 20) or by other suitable structure. Accordingly, in this embodiment the cap 20 is held to the container body 10 by the engagement of the cap opening with the actuator button 40. In addition, because the actuator button 40 serves as a pivot post or axis, the cap 20 can be free to rotate about the exterior of the container body 10, while still being held to the container. A tab or flange 22 can be provided with the cap 20 to allow for manipulation of the cap by the user.

Other methods and structures for captively engaging the cap 20 to the body 10 are also possible. For instance, the cap 20 could be held by a pivot post other than the actuator button 40. Likewise, the cap 20 could include a protrusion or flange that engages a corresponding guide or channel on the container body 10, such that the cap is held to the container body but is also free to move along the container body. Similarly, the cap 20 could have a structure corresponding to an outer part of the container body 10 and configured to snap into or out of a closed position thereon. Likewise, the cap 20 could be held to the body 10 by a hinge and rotate about the hinge.

The cap 20 can include an inner surface that substantially matches the round shape of the outer edge wall 11, such that the cap 20 closely matches the shape of the container body 10, and so as to maintain the substantially round outer configuration of the entire package 9. However, as can be understood, a variety of shapes and configurations could be utilized for the components described herein.

Figure 1F:
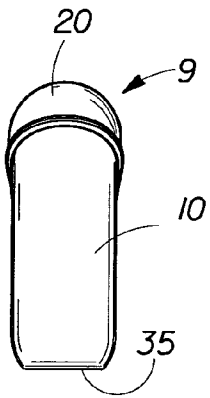
FIG. 1F is a right side elevational view of the embodiment of FIG. 1A.
Figure 1C:
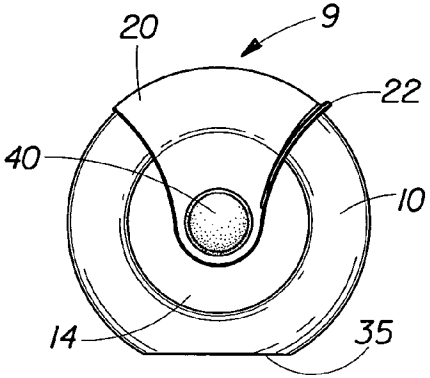
FIG. 1C is a front elevational view of the embodiment of FIG. 1A.
Figure 1G:
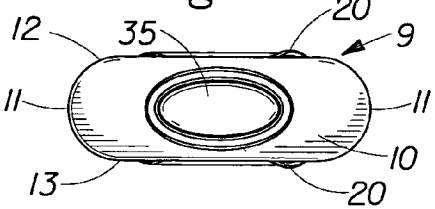
FIG. 1G is a bottom view of the embodiment of FIG. 1A.
Figure 1E:
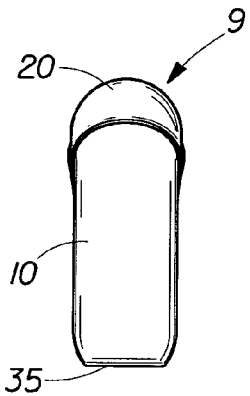
FIG. 1E is a left side elevational view of the embodiment shown in FIG. 1A.

As shown best in FIGS. 1E, 1F, and 1G, the cap 20 might advantageously extend from the front side 12 of the container body 10 to the back side 13 of the container body, so as to cover an applicator portion of the package 9. The cap can be formed of any of a variety of materials suitable for covering and protecting the applicator portion of the package 9. For example, any of a variety of rigid materials could be utilized. Illustrative materials include, but are not limited to, polypropylene, polycarbonate, acrylonitrile butadiene styrene (ABS), and/or other plastics.

In this example, the actuator 40 is provided near the center of the container body 10, and at a location substantially equidistant from the outer edge of the container body, so that it can be easily located by the user when the user picks up the package 9. As mentioned above, the actuator button 40 can be held to the container 10 in any suitable manner. In this example, the actuator 40 can be pushed inwardly by the user in order to cause material to be dispensed from the package 9. Such dispensing action can be provided in any of wide variety of manners, such as by causing a valve to move to an open position, causing a seal to be opened, or otherwise opening a fluid pathway for the pressurized material to escape. When released, the actuator 40 can then return to its predetermined off position, such as by the force of the pressurized material, or under the force of a spring or other biasing member. Although the actuator is shown in this example as a button 40, other devices could be utilized for controlling the dispensing of the product, such as levers, rotary actuators and the like. Also, if desired, duplicate or redundant actuators 40 can be provided on each of the sides 12 and 13 of the package 9, such that the user can dispense the product from either side.

The packages and components described herein can be manufactured by any effective technique as appropriate. For example, the container might be manufactured using a blow molding method, while the cap and actuator might be manufactured using an injection molding method. The pressurized material can be added in a variety of ways as well. For example, the composition can be prepared by adding, individually or as a premix, all ingredients other than the propellant to the container. The container can be sealed and residual air evacuated. The propellant can then be added as a liquefied gas under appropriate pressures to the sealed container. Alternatively, pressured product (with propellant) might be simultaneously added while residual air is evacuated.

Figure 2A:
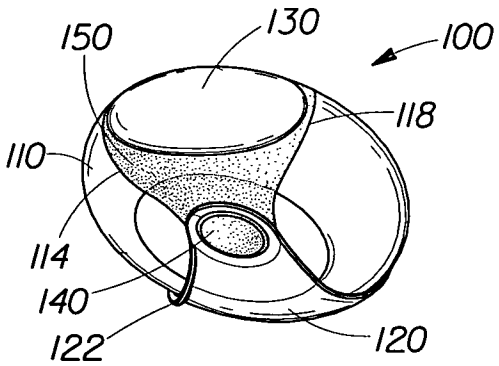
FIG. 2A is a top perspective view of an embodiment similar to that of FIG. 1, with the cap in an open position to reveal an illustrative configuration for the applicator, in accordance with principles of the present invention.
Figure 2B:
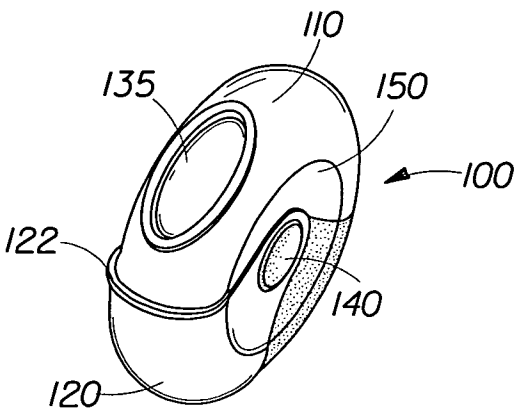
FIG. 2B is a bottom perspective view of the embodiment of FIG. 2A.
Figure 2D:
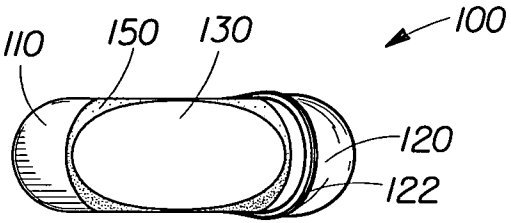
FIG. 2D is a top view of the embodiment of FIG. 2A.
Figure 2F:
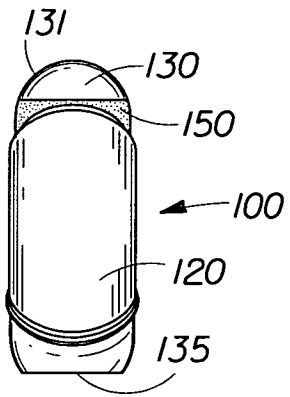
FIG. 2F is a right side elevational view of the embodiment of FIG. 2A.
Figure 2C:
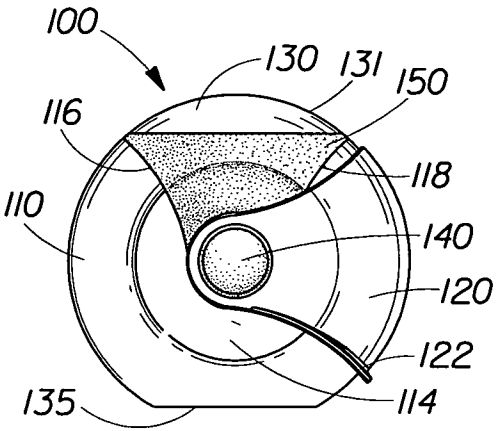
FIG. 2C is a front elevational view of the embodiment of FIG. 2A.
Figure 2G:
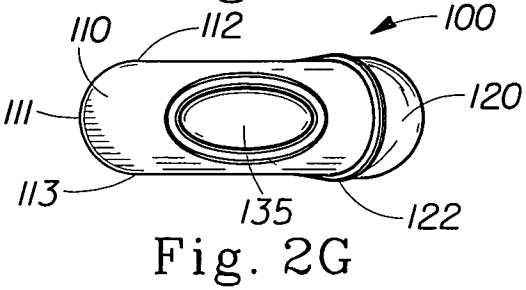
FIG. 2G is a bottom view of the embodiment of FIG. 2A.
Figure 2E:
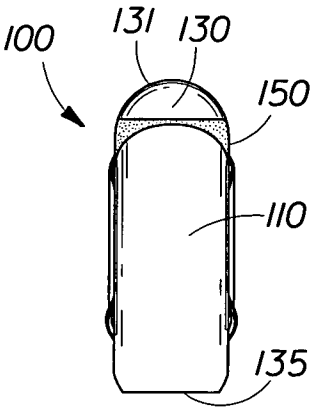
FIG. 2E is a left side elevational view of the embodiment shown in FIG. 2A.

FIGS. 2A-2B show various views of an additional embodiment of a package 100 made according to principles of the present invention. The package 100 is similar to the package 9 shown in FIG. 1, except that the cap 120 is moved to an open position to reveal one illustrative configuration of an applicator 130. The container body 110, cap 120, flange 122, actuator button 140, bottom surface 135, and other elements with reference numerals ending in the same two digits as those in FIG. 1, are illustrated as being substantially the same as the corresponding elements shown in FIG. 1, and so discussion of these elements will not be repeated.

In this embodiment, the applicator 130 comprises a dome or convex shaped member, so as to appropriately correspond with a body part or surface to be treated. For example, for an anti-persperant product, it might be advantageous for applicator 130 to include a surface which closely conforms to the shape and characteristics of an underarm surface to which it is to be placed. The applicator 130 can be held to the container body 110 in any of a number of appropriate ways. In this example, a collar 150 is secured to the container body 110, such that the container body includes the collar 150. The dome applicator 130 is then secured to the collar 150. If the container body 110 is provided with a center opening, this collar can be held between two ends 116 and 118 of the container. Thus, in this example, the container body 110 is a tubular member with ends 116/118 generally spaced from one another and facing each other, with the applicator 130 situated substantially within the opening defined by the tubular member. Other configurations are also possible, such as by placing the collar 150 over the container body 110. As another alternative, the separate collar 150 can be eliminated such that the applicator 130 can be connected or integrally formed with the container body 110. In the example shown, the curvature of the dome applicator 130 as well as the curvature of the cap 120 are substantially similar to or generally correspond with the curvature of the outer edge of the container body 110, such that the overall package 100 provides a substantially round and nearly circular appearance.

The dome applicator 130 can be made from a variety of materials including, but not limited to, a perforated or foraminous member, a screen or woven member, or porous and/or absorbent materials, which allow spray to be delivered outwardly from the package 100 from beneath the applicator 130. A diffuser (See FIG. 8*b*, 190) or manifold arrangement (not shown) can be provided beneath the applicator 130 so as to appropriately distribute the spray to the inner surface of the dome applicator 130, when the applicator is placed adjacent the skin surface and the actuator button 140 is pressed. The applicator material 130 allows at least some of the diffused material to be passed so as to touch the skin. The applicator 130 can also absorb at least some of the sprayed material to allow the material to be provided at the outer surface of the applicator and adjacent the skin for mechanical application, and to absorb any material reflected back from the skin.

Figure 3A:
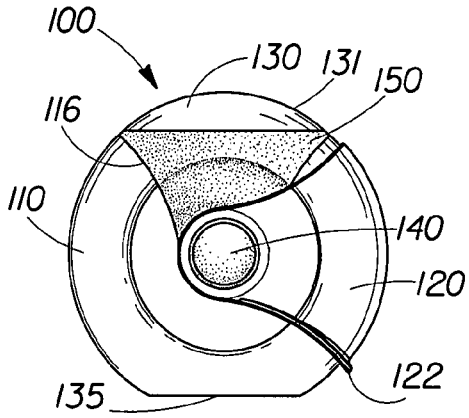
FIG. 3A is a front perspective view of the embodiment of FIGS. 2A-G, with the cap shown in a 90° position, according to principles of the present invention.
Figure 3B:
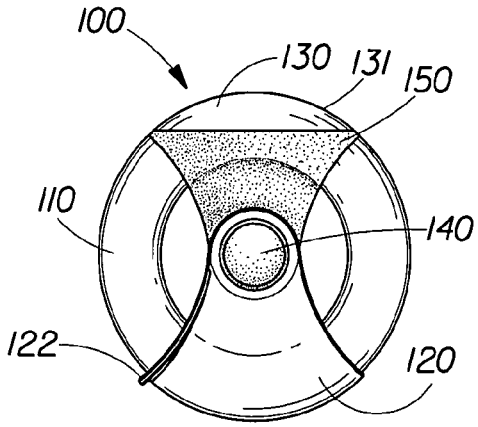
FIG. 3B is a front perspective view of the embodiment of FIGS. 2A-G, with the cap shown in a 180° position, according to principles of the present invention.
Figure 3C:
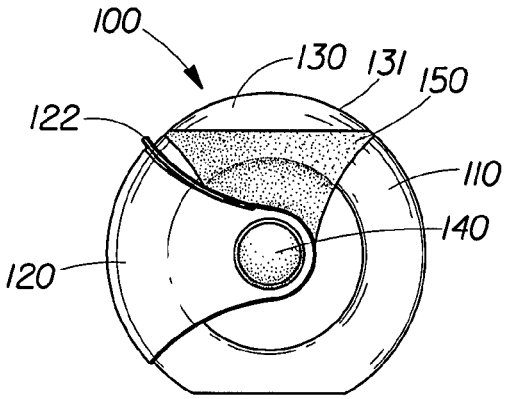
FIG. 3C is a front perspective view of the embodiment of FIGS. 2A-G, with the cap shown in a 270° position, according to principles of the present invention.

The cap 120 can also be moved to a variety of open positions to expose the applicator 130 and allow it to be placed adjacent the skin during use. Examples of such positions are shown in FIGS. 3A-3C. In particular, the cap 120 has been rotated open (from its closed position overlying applicator 130) to a ninety degree position in FIG. 3A, the cap has been rotated open to a one hundred eighty degree position in FIG. 3B, and the cap has been rotated open to a two hundred and seventy degree position in FIG. 3C. Once the use of the product is complete, the cap 120 can then again be rotated to a closed position, such as the position shown in FIG. 1.

During this movement of the cap 120 between a closed position, in which the applicator 130 is shielded, and an open position in which the applicator is exposed, the cap 120 can be mechanically held in one or more of the selected positions. In particular, a protrusion or other mechanical detent or interlock arrangement can be provided on the cap 120 or container body 110, and a corresponding indentation, notch or corresponding detent device can be provided on the other member, such that the two at least sufficiently engage when the cap 120 reaches a particular rotation position to temporarily hold the cap in position and/or provide a tactile indication to the user of proper positioning. Other structures could alternatively be utilized for this purpose, such as through the engagement of a rib and channel, or through other locking or detent structures. It is contemplated that the engagement can be selectively overcome by the force of the user's hand as the user rotates the cap 120 to another position.

If desired, each of the various positions of the cap 120 shown in FIG. 3 could also cause a predetermined dosage amount of the pressurized material to be selected. Such a selection or "dialing" of the dosage by the movement of the cap 120 could be obtained using any of a variety of configurations. For instance, each of the positions shown in FIG. 3 could move the actuator button 140 into engagement with a valve of a separate chamber within the container body 110, each of the chambers having a different measured dose volume for material to be delivered. Pressing the actuator button 140 could then cause the engaged valve to be moved to an open position and cause the measured dose to be released from the diffuser 190 and through the applicator dome 130. Exemplary valve assembly structures for delivering metered doses of pressurized material are described in U.S. patent application Ser. No. 10/146,001, entitled Metered-Dose Underarm Product and Package, the entire disclosure of which is hereby incorporated herein by reference.

Moreover, movement of the cap 120 to the closed position could also disable the actuator button 140. For example, an extension on the cap 120 could slide over or under the button 140 or otherwise prevent reciprocation of the button when the cap is moved to the closed position. Thus, the actuator button 140 would be prevented from being pressed when the cap 120 is in the closed position, and unintended spraying of the pressurized material is prevented.

Figure 4A:
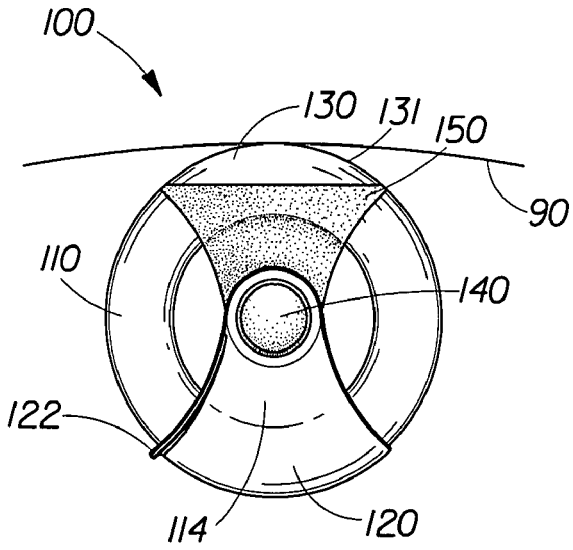
FIG. 4A is a front view of the illustrative embodiment of FIGS. 2A-G being applied to the skin, in accordance with principles of the present invention.
Figure 4B:
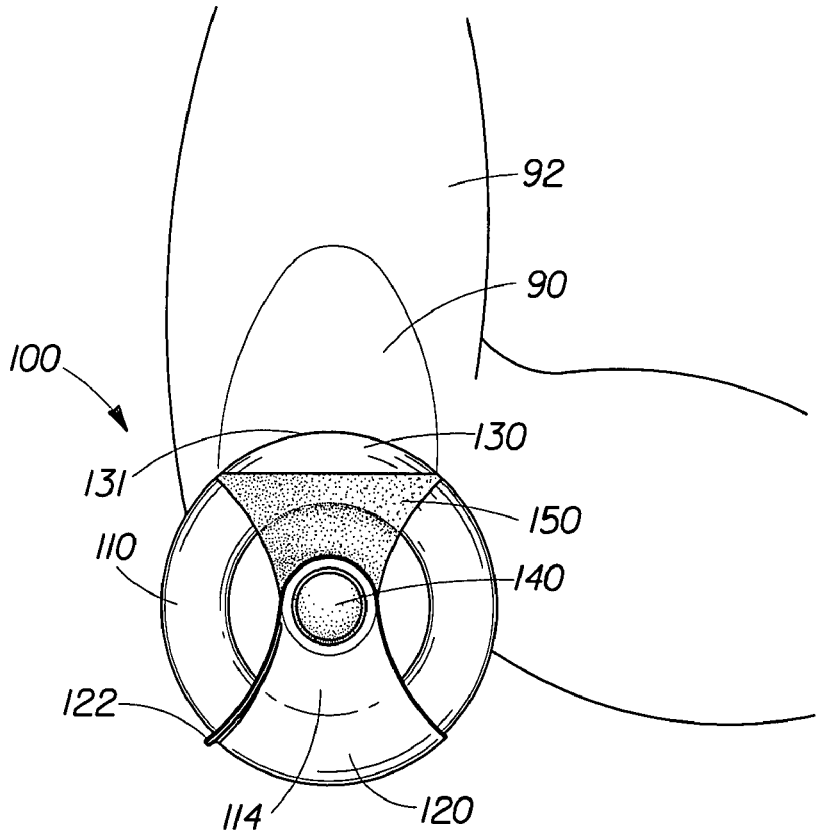
FIG. 4B is a front view of the illustrative embodiment of FIGS. 2A-G being applied to the underarm, in accordance with principles of the present invention.

FIGS. 4A and 4B show an illustrative method of use of the package 100. As shown in this example, the cap 120 is rotated to an open position to expose the applicator 130. The exemplary package 100 might be conveniently sized to fit easily within the users hand between the front and back sides of the container body 110. Accordingly, such a package 100 would be held in the user's hand and the applicator 130 placed adjacent the user's skin 90 beneath the arm 92 and shoulder 94. The user then presses one of the actuator buttons 140 using a thumb or finger of the hand that is holding the product package 100. Pressing of the button 140 then causes pressurized material to be released from a diffuser 190 beneath the applicator 130 and toward the skin 90.

Figures 5A, 5B, 5C, 5D, 5E, 5F, 5G:
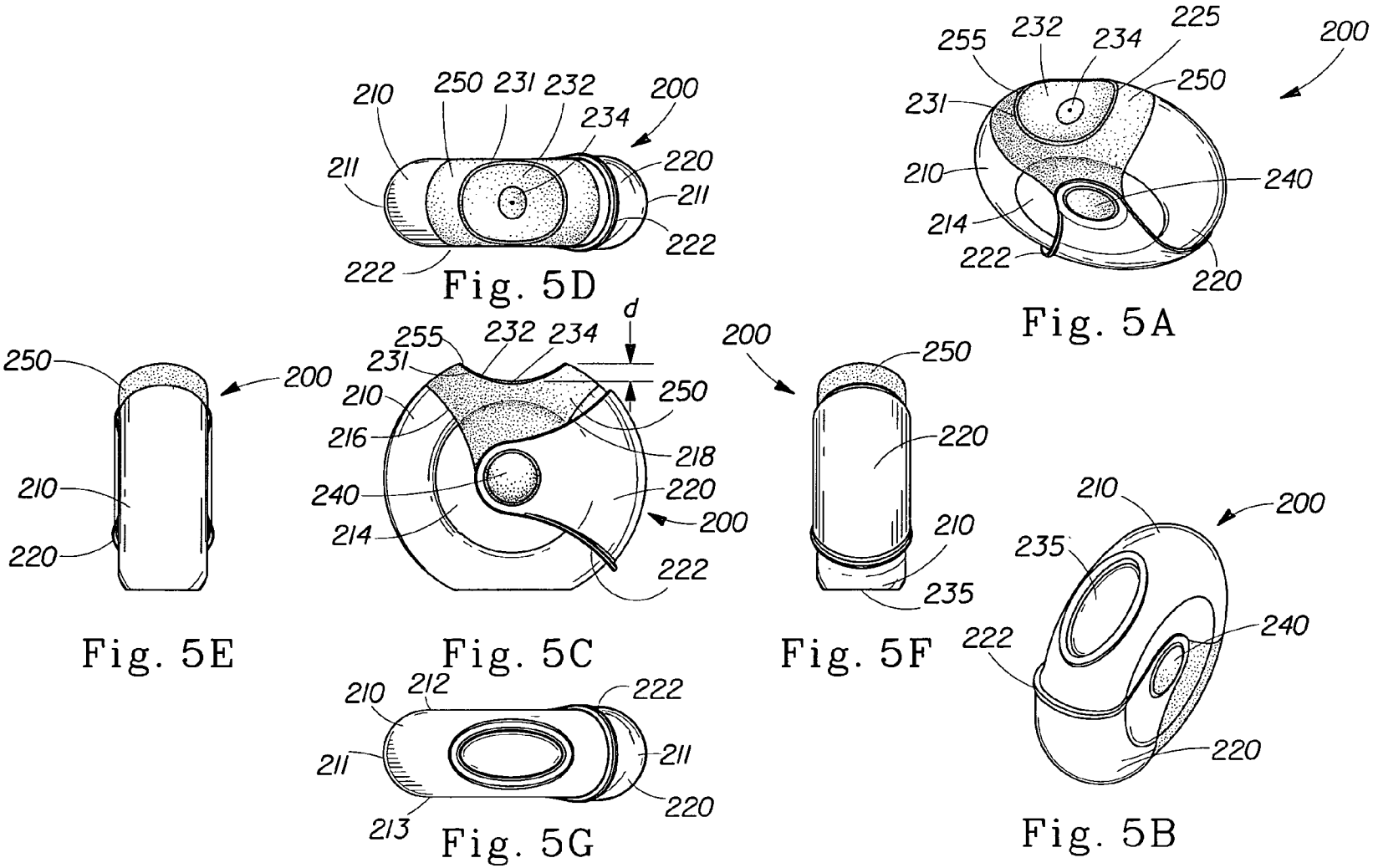
FIG. 5A is a top perspective view of an embodiment similar to that of FIGS. 1A-G, with the cap in an open position to reveal another illustrative configuration for the applicator, in accordance with principles of the present invention.
FIG. 5B is a bottom perspective view of the embodiment of FIG. 5A.
FIG. 5C is a front elevational view of the embodiment of FIG. 5A.
FIG. 5D is a top view of the embodiment of FIG. 5A.
FIG. 5E is a left side elevational view of the embodiment shown in FIG. 5A.
FIG. 5F is a right side elevational view of the embodiment of FIG. 5A.
FIG. 5G is a bottom view of the embodiment of FIG. 5A.

FIG. 5 shows various views of an additional embodiment of a package 200 made according to principles of the present invention. The package 200 is similar to the package 9 shown in FIG. 1, except that the cap 220 is illustrated as being moved to an open position to reveal another illustrative configuration of an applicator. The illustrated container body 210, cap 220, flange 222, actuator button 240, collar 250, bottom surface 235 and other elements referenced with the same final two digits as those in FIG. 1, are substantially the same as the corresponding elements shown in FIGS. 1 and 2, and so detailed discussion of these elements will not be repeated.

In this example, the container body comprises the container body 210 connected with the collar 250, and the applicator comprises a spray nozzle 234 positioned along a recessed surface 232 in the collar 250. The nozzle can comprise any suitable spray nozzle, opening, or dispensing device, with the desired shape or configuration for providing the appropriate spray pattern.

Likewise, the recessed surface 232 can be provided in a variety of shapes and sizes. In this example, the surface 232 comprises a concave or inwardly curved surface. However, the recessed surface 232 could be provided as one or more other curved surfaces, such as saddle-shaped surfaces for example, one or more flat surfaces, or a combination of flat and curved surfaces, which extend inwardly from outer portions of the container body. As another example, the recessed surface 232 could be provided by providing the container body with a cone or other hollow extension and including a surface within the extension at which the spray nozzle 234 can be located.

The example of FIG. 5 shows that the concave surface 232 is bounded by an edge 231 of the collar 250 which is to face toward the body during use. By recessing the surface 232 by a distance d from the outermost portion of the edge 231, a distance can be maintained between the nozzle 234 and the surface of the skin to which the spray is to be applied. By maintaining this distance, it can be assured that the nozzle 234 is not placed too close to the skin during use, as such closeness between skin and nozzle can create poor application of the sprayed product, an undesirable sensory experience for the user, and/or the dripping of product down the skin and/or onto clothing. Likewise, because the edge 231 can be placed in contact with the skin, particularly at skin contact points 255 along the edge 231, without actually contacting the skin with the nozzle 234, it can be assured that the product is not held too far from the skin. As mentioned above, holding the product too far from the skin can create a unwanted cloud of sprayed material, can prevent the material from adequately covering the skin, and/or can cause the material to be directed onto clothing.

Figure 6A:
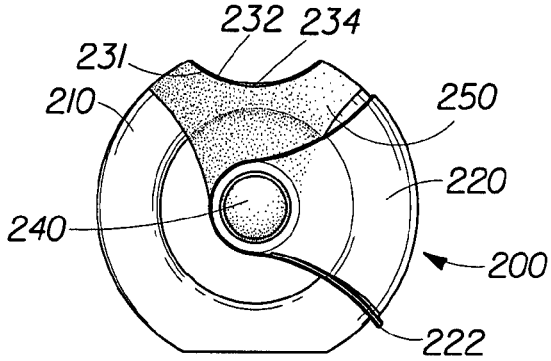
FIG. 6A is a front perspective view of the embodiment of FIGS. 5A-G, with the cap shown in a 90° position, according to principles of the present invention.
Figure 6B:
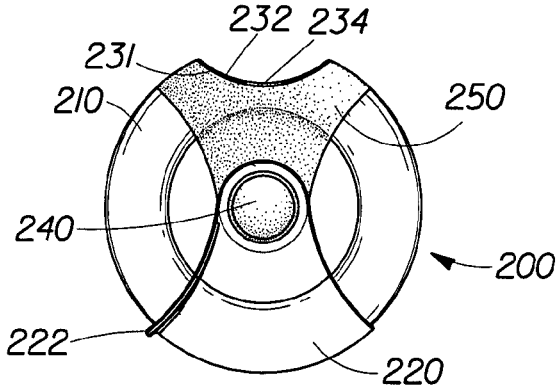
FIG. 6B is a front perspective view of the embodiment of FIGS. 5A-G, with the cap shown in a 180° position, according to principles of the present invention.
Figure 6C:
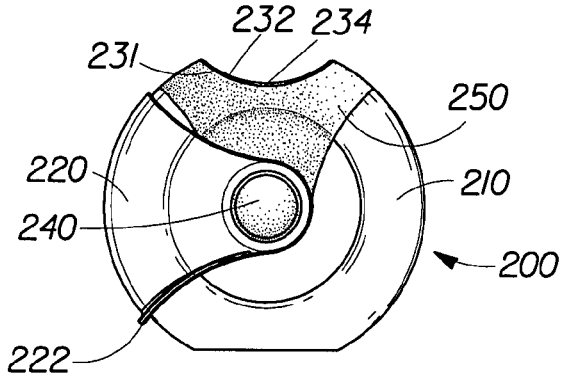
FIG. 6C is a front perspective view of the embodiment of FIGS. 5A-G, with the cap shown in a 270° position, according to principles of the present invention.

As with the other embodiments, the cap 220 can be moved to a variety of open positions to expose the spray nozzle 234 and allow the recessed surface 232 to be placed adjacent the skin during use. Examples of such positions are shown in FIG. 6. In particular, the cap 220 has been rotated to a ninety degree position in FIG. 6A, the cap has been rotated to a one hundred eighty degree position in FIG. 6B, and the cap has been rotated to a two hundred and seventy degree position in FIG. 6C. Once the use of the product is complete, the cap 220 can then again be rotated to a closed position, such as the position shown in FIG. 1, so that it covers the spray nozzle applicator 234. In addition, as with the embodiment of FIG. 3 described above, the cap 220 can be held into one or more of the selectable positions, can control the dosage of spray based upon its position, and/or can lock the actuator when in the closed position, if desired.

Figure 7A:
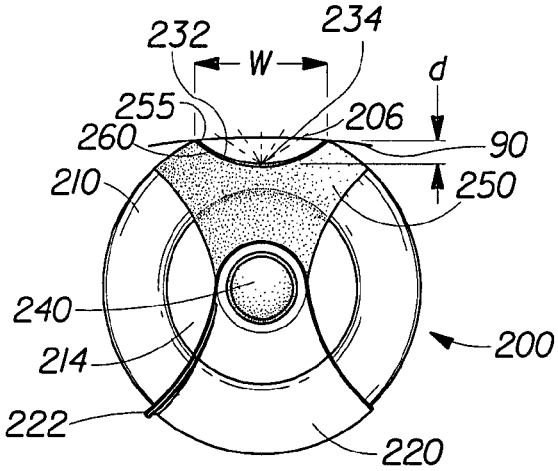
FIG. 7A is a front view of the illustrative embodiment of FIGS. 5A-G being applied to the skin, in accordance with principles of the present invention.
Figure 7B:
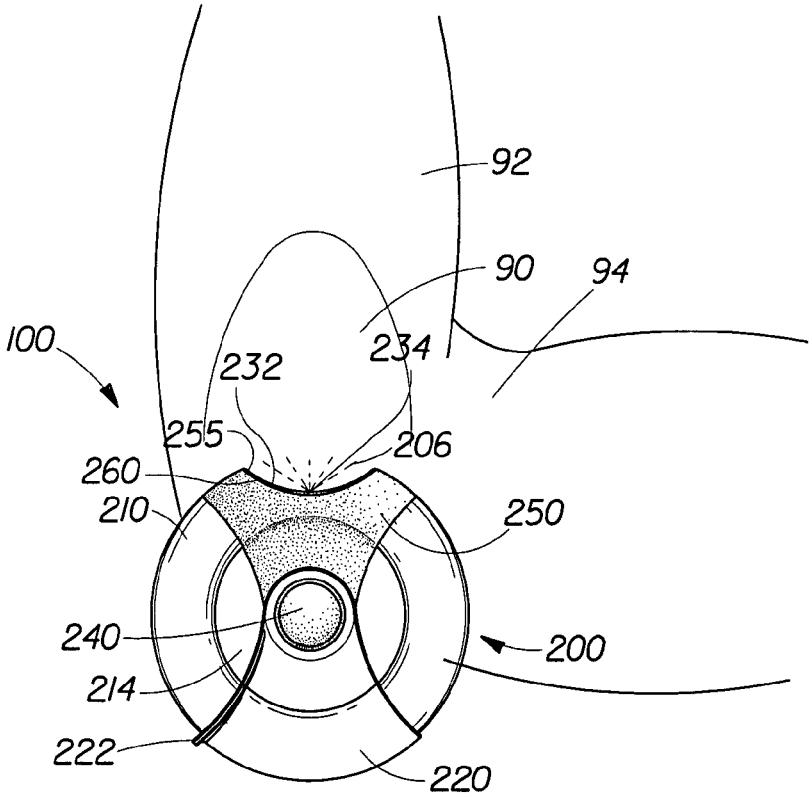
FIG. 7B is a front view of the illustrative embodiment of FIGS. 5A-G being applied to the underarm, in accordance with principles of the present invention.

An exemplary method of use of the product 200 will now be described with reference to FIGS. 7A and 7B. In this example, the cap 220 of the pressurized package 200 is rotated to an open position while remaining captively engaged with the container body 210/250. The package is then held adjacent to the underarm skin 90 by the user's hand. In particular, the package 200 can be held directly adjacent the skin such that the contact points 255 are in contact with the skin 90. The user then presses the actuator button 240 with a finger or thumb to cause the spray 206 to be released and dispersed from the nozzle 234 and toward the skin 90. Because the contact points 255 maintained the distance d between the skin 90 and the nozzle 234, more desirable spraying of the product can be obtained. After use, the cap 220 can be returned to the closed position, such that the cap covers and protects the nozzle 234. Preferably, the actuator button 240 is also disabled when the cap 220 is in the closed position. Moreover, the recessed surface 232 can be covered with an absorbent material 260 to absorb sprayed material that is deflected back toward the package 200, to decrease the risk that the reflected material is applied to clothing or other unintended surfaces.

Figure 8A:
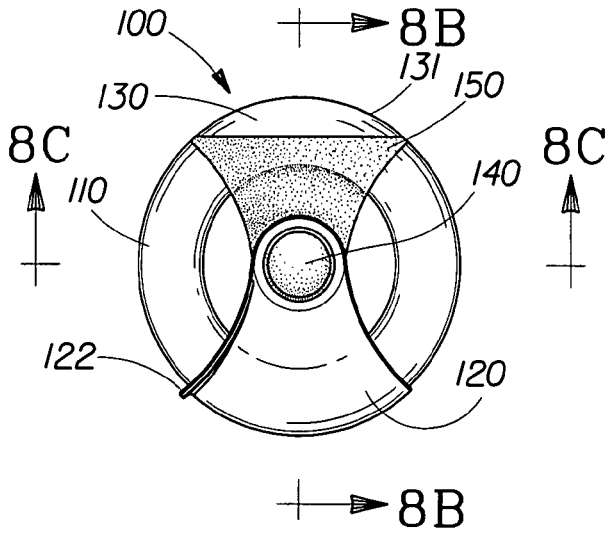
FIG. 8A is a front view of the embodiment of FIGS. 2A-G, with the cap shown in the 180° position.
Figure 8B:
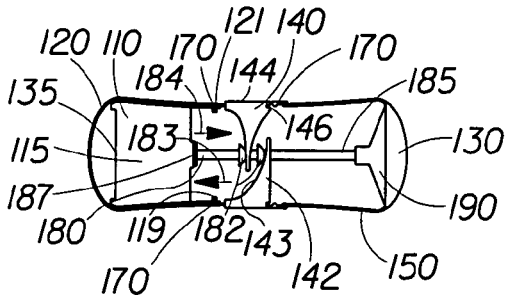
FIG. 8B is a cross-sectional view taken along line B-B of FIG. 8A.
Figure 8C:
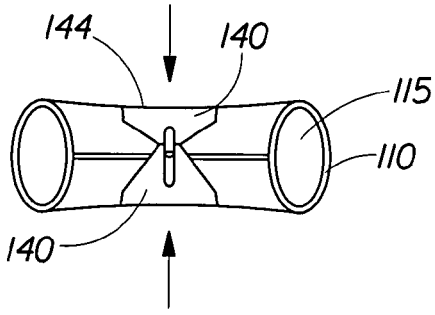
FIG. 8C is a cross-sectional view taken along line C-C of FIG. 8A.

FIG. 8A is a front view of the embodiment of FIG. 2, with the cap 120 shown in the 180 degree (downward) open position. FIG. 8B is a cross-sectional view taken along line B-B of FIG. 8A, and FIG. 8C is a cross-sectional view taken along line C-C of FIG. 8A. As shown in this example, the container body 110 can comprise a hollow, tubular member that extends in a substantially round configuration. As best shown in FIGS. 8A and 8B, the tubular member need not be continuous, but rather can have a pair of ends 116 and 118, about which the collar 150 is placed. Also, the container body 110 need not necessarily have a uniform cross section. For example, as shown in FIGS. 8B and 8C, while portions of the container body 110 can have substantially round or substantially circular cross-sections, other portions, such bottom portion 135 can have a substantially rectangular cross section. The container body 110 includes a cavity 115 within which the pressurized material is placed.

FIGS. 8B and 8C also show details of an illustrative embodiment of an actuator mechanism, including buttons 140. In this particular example, the buttons 140 are located on both sides of the package 100 and are held within the collar 150 and within the cap 120. It will be understood that this arrangement could similarly be implemented with only one of the button devices. In this embodiment, each of the buttons 140 also includes an exterior contact surface 144 as well as an interior extension portion 142 and a cam surface 143 formed on the interior extension portion 142. Each of the cam surfaces 143 engages a nozzle 182, which in turn moves an actuator stem 180. The actuator stem 180 then controls a valve 187 which, when moved to the open position, permits the pressurized material within the cavity 115 to escape. Accordingly, the pressurized fluid can, in turn, travel through the actuator stem 180, through the nozzles 182, through the stem 185 and out of the diffuser 190 where it is released as a spray. The spray can then escape through and/or be provided at the outer surface of the applicator surface 130 and be applied to a body surface.

The valve 187 and stem actuator 180 can comprise any suitable arrangement for releasing pressurized material, such as fluid. In particular, an opening can be provided on the valve 187 and this opening could be moved into the cavity 115 upon movement of the stem 180 in the open direction 183, so as to allow for pressurized material to enter the opening and escape through the valve and stem actuator 180. The pressure of the material in the cavity 115 could provide a bias against the valve 187 to force the valve in a normally closed direction 184 when the user releases the button 140, and to thereby maintain the valve in a normally closed position. Alternatively biasing mechanisms such as springs or the like could be utilized to apply pressure to maintain the valve 187 in the normally closed position and/or to maintain the actuator buttons 140 in an off position. While FIG. 8 depicts an illustrative embodiment, one of ordinary skill in the art can appreciate that any of a variety of structures and arrangements for controlling and releasing pressurized fluid could equally be used.

The example of FIG. 8 also includes protrusions or detents 170 which can be provided on the cap 120 to hold the cap in one or more selected positions. In particular, one or more corresponding recesses 119 or stops can be provided at desired locations on the container body 110 and/or on the collar 150 to engage the protrusions and hold the cap 120 in a selected position. The engagement of the protrusions 170 with the corresponding recesses 119 can then be overcome by the force of the user's hand rotating the cap 120 to another position.

In addition, the embodiment of FIG. 8 also shows that the cap 120 can include locking extensions 121 which can engage the actuator buttons 140 when the cap 120 is rotated to its closed position where it covers the applicator 130. In particular, in this example, the locking extension 121 engages a corresponding locking recesses 146 on the buttons 140. Thus, the cap 120 can disable the actuator buttons 140 when the cap 120 is in the closed position, and inadvertent discharge of the pressurized material can be avoided.

Having shown and described various embodiments of the present invention, further adaptations of the present invention can be accomplished by appropriate modifications by one of ordinary skill in the art without departing from the scope of the present invention. Several of these potential modifications and alternatives have been mentioned, and others will be apparent to those skilled in the art. Accordingly, the scope of the invention should be considered in terms of the following claims and is understood not to be limited to the details of the structure, operation, or process steps as shown and described in the specification and drawings.

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the term in a document incorporated herein by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for applying a material to the body, said package comprising:

a container body comprising a cavity, a substantially toroidal-shaped outer surface, a flat bottom side for placement of the package on a flat surface, and a top portion situated in opposing relationship to said flat bottom side, said top portion including a surface that is sized and configured for placement adjacent skin of a user's underarm;

a cap captively engaged with said container body, wherein said cap is movable over said outer surface between a closed position and an open position, and wherein said cap comprises a flange to allow for manipulation of said cap by a user; and an actuator button that serves as a pivot post or axis for the cap to rotate between said closed position and said oven position.

2. The package as recited in claim 1, wherein said top portion comprises an applicator that includes a dome or convex shaped surface for placement against skin or a user's underarm.

3. The package as recited in claim 1, wherein said cap has a shape that corresponds to said substantially toroidal-shaped outer surface so as to freely move along the container body between said closed position and said open position.

4. A package for applying material directly to the body, said package comprising:

a container body comprising a cavity, a substantially toroidal-shaped outer surface, and a flat bottom side for placement of the package on a flat surface;

a cap captively engaged with said container body, wherein said cap is movable over said outer surface between a closed position and an open position; and an actuator that is manipulatable for dispending material contained with said cavity and that also serves as a pivot post or axis for said cap to rotate between said open position and said closed position.

5. The package as recited in claim 4, further comprising a top portion situated in opposing relationship to said flat bottom side, said top portion including a surface that is sized and configured to correspond to a body part or surface to be treated with material contained within said cavity.

* * * * *